US011818550B2

(12) United States Patent
Johnson

(10) Patent No.: US 11,818,550 B2
(45) Date of Patent: Nov. 14, 2023

(54) HEARING INSTRUMENTS WITH RECEIVER POSTERIOR TO BATTERY

(71) Applicant: Starkey Laboratories, Inc., Eden Prairie, MN (US)

(72) Inventor: Andrew Joseph Johnson, Edina, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 0 days.

(21) Appl. No.: 17/672,840

(22) Filed: Feb. 16, 2022

(65) Prior Publication Data

US 2022/0174434 A1 Jun. 2, 2022

Related U.S. Application Data

(63) Continuation of application No. PCT/US2020/048452, filed on Aug. 28, 2020.

(60) Provisional application No. 62/894,025, filed on Aug. 30, 2019.

(51) Int. Cl.
*H04R 25/00* (2006.01)
*H04R 31/00* (2006.01)

(52) U.S. Cl.
CPC ..... *H04R 25/602* (2013.01); *H04R 25/609* (2019.05); *H04R 31/00* (2013.01); *H04R 2225/021* (2013.01); *H04R 2225/31* (2013.01)

(58) Field of Classification Search
None
See application file for complete search history.

(56) References Cited

U.S. PATENT DOCUMENTS

| | | | |
|---|---|---|---|
| 3,102,172 | A | 8/1963 | Cohen |
| 4,069,400 | A | 1/1978 | Johanson et al. |
| 4,395,601 | A | 7/1983 | Kopke et al. |
| 5,185,802 | A | 2/1993 | Stanton |
| 5,201,008 | A | 4/1993 | Arndt et al. |
| 5,204,917 | A | 4/1993 | Arndt |
| 5,785,661 | A | 7/1998 | Shennib |
| 6,459,800 | B1 | 10/2002 | Brimhall |
| 6,546,110 | B1 | 4/2003 | Vonlanthen |
| 6,731,770 | B1 | 5/2004 | Vonlanthen |
| 6,735,319 | B1 | 5/2004 | Vonlanthen |
| 7,151,839 | B2 | 12/2006 | Niederdrank |
| 7,403,629 | B1 | 7/2008 | Aceti et al. |

(Continued)

FOREIGN PATENT DOCUMENTS

| | | | | |
|---|---|---|---|---|
| EP | 1871141 | A2 | 12/2007 | |
| WO | WO-2009120148 | A1 * | 10/2009 | ..... H04R 25/602 |

OTHER PUBLICATIONS

International Preliminary Report on Patentability from International Application No. PCT/US2020/048452, dated Mar. 10, 2022, 11 pp.

(Continued)

*Primary Examiner* — Mark Fischer
(74) *Attorney, Agent, or Firm* — Shumaker & Sieffert, P.A.

(57) ABSTRACT

As described in some examples of this disclosure, a Behind-The-Ear (BTE) hearing instrument comprises processing circuity, a battery that stores energy for use by the processing circuitry, and a housing that contains a receiver configured to output sound. The receiver is positioned within the hearing instrument posterior to the processing circuitry and the power source.

11 Claims, 8 Drawing Sheets

(56) References Cited

U.S. PATENT DOCUMENTS

| | | | | |
|---|---|---|---|---|
| 7,403,630 | B2 | 7/2008 | Jørgensen et al. | |
| 7,440,579 | B2 | 10/2008 | Vonlanthen | |
| 7,480,388 | B1 | 1/2009 | Crook | |
| 7,971,337 | B2 | 7/2011 | Kral et al. | |
| 8,385,574 | B2 | 2/2013 | Aquilina et al. | |
| 8,437,860 | B1 * | 5/2013 | Crawford | H04R 25/609 607/139 |
| 8,442,252 | B2 | 5/2013 | Meosky et al. | |
| 10,911,878 | B2 | 2/2021 | Higgins et al. | |
| 2003/0123687 | A1 | 7/2003 | Petrick et al. | |
| 2004/0120539 | A1 | 6/2004 | Panitzsch | |
| 2007/0147643 | A1 | 6/2007 | Grafenberg | |
| 2008/0002849 | A1 | 1/2008 | Tan | |
| 2008/0056520 | A1 * | 3/2008 | Christensen | H04R 25/602 343/866 |
| 2009/0262964 | A1 | 10/2009 | Havenith et al. | |
| 2010/0014696 | A1 | 1/2010 | Boschung et al. | |
| 2011/0019849 | A1 | 1/2011 | Nielsen | |
| 2017/0325036 | A1 * | 11/2017 | Angst | H04R 25/604 |
| 2020/0204933 | A1 * | 6/2020 | Higgins | H04R 1/1075 |

OTHER PUBLICATIONS

International Search Report and Written Opinion of International Application No. PCT/US2020/048452, dated Jan. 15, 2021, 18 pp.

* cited by examiner

HEARING INSTRUMENTS WITH RECEIVER POSTERIOR TO BATTERY

This application is a continuation of International Application No. PCT/US2020/048452, filed Aug. 28, 2020, which claims the benefit of U.S. Provisional Patent Application 62/894,025, filed Aug. 30, 2019, the entire content of both of which are incorporated by reference.

TECHNICAL FIELD

This disclosure relates to hearing instruments.

BACKGROUND

Hearing instruments are devices designed to be worn on, in, or near one or more of a user's ears. Common types of hearing instruments include hearing assistance devices (e.g., "hearing aids"), earbuds, headphones, hearables, cochlear implants, and so on. In some examples, a hearing instrument may be implanted or osseointegrated into a user. Some hearing instruments include additional features beyond just environmental sound-amplification. For example, some modern hearing instruments include advanced audio processing for improved device functionality, controlling and programming the devices, and beamforming, and some can even communicate wirelessly with external devices including other hearing instruments (e.g., for streaming media).

SUMMARY

This disclosure describes hearing instruments with receivers positioned posterior to batteries. As described herein, a behind-the-ear (BTE) hearing instrument includes a housing that is worn behind an ear of a user. The housing encloses processing circuitry, a battery, and a receiver. The receiver is a device that includes one or more speakers. The BTE hearing instrument also includes or defines a tube that directs sound generated by the receiver into an ear canal of the ear of the user. As described in this disclosure, the receiver is positioned posterior to the battery when the BTE hearing instrument is worn behind the ear of the user.

In one example, this disclosure describes a Behind-The-Ear (BTE) hearing instrument comprising: processing circuity; a battery that stores energy for use by the processing circuitry; and a housing that contains a receiver configured to output sound, wherein the receiver is positioned within the hearing instrument posterior to the processing circuitry and the power source.

In another example, this disclosure describes a method of assembling hearing instruments, the method comprising: obtaining first processing circuitry and second processing circuitry, wherein the first processing circuitry is identical to the second processing circuitry; including the first processing circuitry in a housing of a behind-the-ear part of a Receiver-In-Canal (RIC) hearing instrument; and including the second processing circuitry in a housing of a Behind-The-Ear (BTE) hearing instrument, wherein the BTE hearing instrument is configured to include a receiver posterior to a battery of the BTE hearing instrument and the second processing circuitry.

In another example, this disclosure describes a kit comprising: a processing module comprising processing circuitry and processing module contact pins; and a BTE body module comprising: first body module contact pins arranged to contact the processing module contact pins when the BTE body module is mated with the processing module; and a receiver configured to produce sound based on signals received from the processing module via the processing module contact pins and the first body module contact pins, wherein a tube of the BTE body module directs the sound and the receiver is posterior to a battery that provides power to the processing module when the BTE body module is mated with the processing module; and a RIC body module comprising: second body module contact pins arranged to contact the processing module contact pins when the RIC body module is mated with the processing module; and a cable configured to transmit electrical signals from the processing module via the processing module contact pins and the second body module contact pins.

The details of one or more aspects of the disclosure are set forth in the accompanying drawings and the description below. Other features, objects, and advantages of the techniques described in this disclosure will be apparent from the description, drawings, and claims.

DETAILED DESCRIPTION

Figure 1:
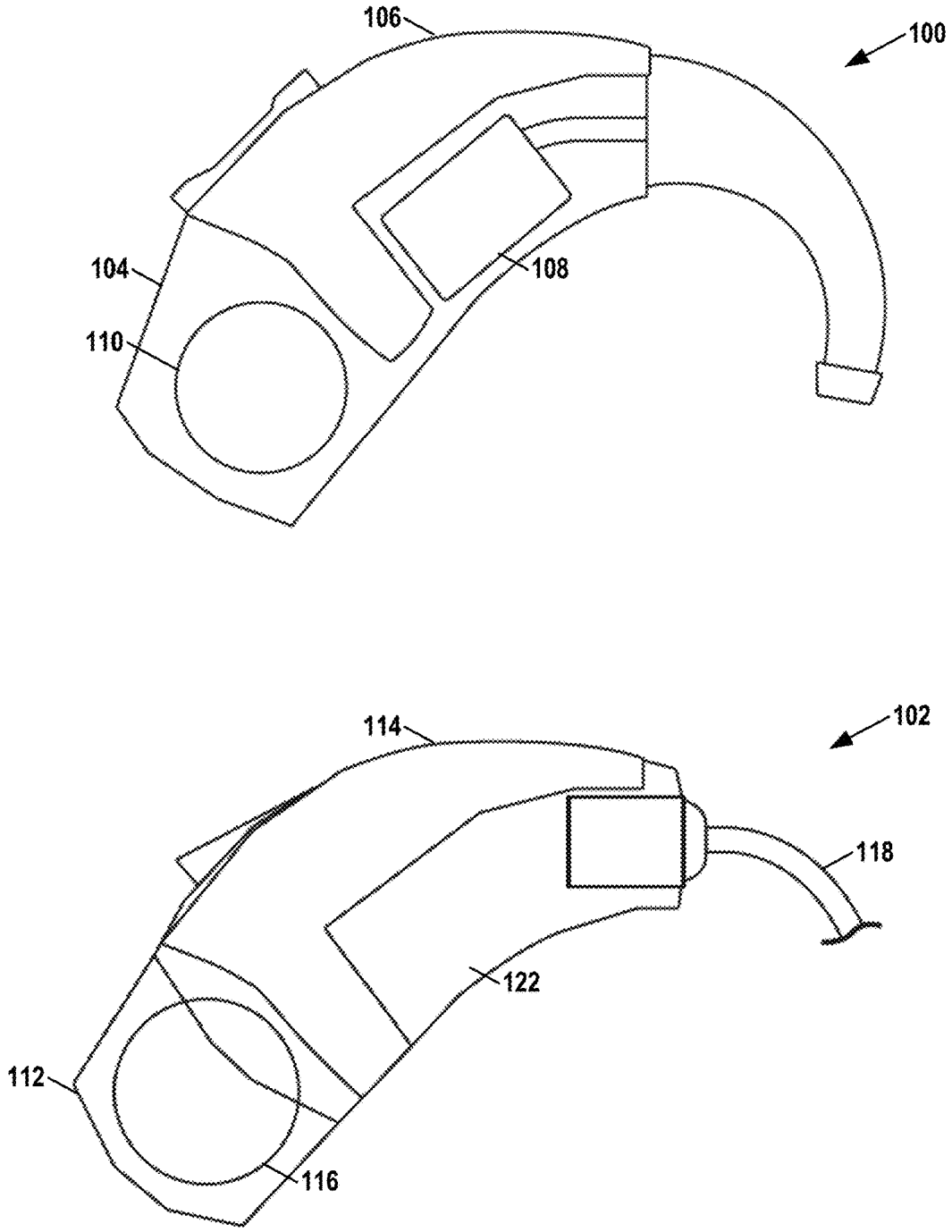
FIG. 1 PRIOR ART
FIG. 1 is a conceptual diagram of a behind-the-ear (BYE) hearing instrument and a Receiver-In-Canal (RIC) hearing instrument.

FIG. 1 is a conceptual diagram of a behind-the-ear (BTE) hearing instrument 100 and a Receiver-In-Canal (RIC) hearing instrument 102. As shown in the example of FIG. 1, BTE hearing instrument 100 includes a housing 104 that encloses processing circuitry 106, a receiver 108, and a battery 110. RIC hearing instrument 102 includes a housing 112 that encloses processing circuitry 114 and a battery 116. In both BTE hearing instrument 100 and RIC hearing instrument 102, processing circuitry 106 and processing circuitry 114 may perform processing functions. For example, processing circuitry 106, 114 may include signal processors that process signals representing sound detected by microphones of hearing instruments 100, 102. For instance, throughout this disclosure, examples of processing circuitry may be configured to modify, based on user-specific settings, signals representing sound detected by microphones. Batteries 110, 116 provide electrical energy to various components of hearing instruments 100, 102, including processing circuitry 106, 114, and, in the case of BTE hearing instrument 100, receiver 108.

Receiver 108 of BTE hearing instrument 100 is a device that includes one or more speakers that output sound. The sound generated by receiver 108 passes through a tube that guides the sound into an ear of a user of BTE hearing instrument 100. In the case of RIC hearing instrument 102, RIC hearing instrument 102 includes a behind-the-ear portion and an in-ear portion. FIG. 1 shows the behind-the-ear portion of RIC hearing instrument 102. The in-ear portion of RIC hearing instrument 102 (not shown in FIG. 1) contains a receiver that outputs sound directly into an ear canal of the user of RIC hearing instrument 102. A tether 118 connects the behind-the-ear portion of RIC hearing instrument 102 to the in-ear portion of RIC hearing instrument 102. Tether 118 may conduct electrical or optical signals between the behind-the-ear portion of RIC hearing instrument 102 and the in-car portion of RIC hearing instrument 102.

BTE hearing instruments, such as BTE hearing instrument 100, and RIC hearing instruments, such as RIC hearing instrument 102, may have different advantages and disadvantages relative to one another. For example, receivers of BTE hearing instruments may be able to output louder sounds than receivers of RIC hearing instruments. Outputting louder sounds may be helpful for users with more profound hearing loss. However, the tubes used with BTE hearing instruments to guide sound into the ears of users may be more conspicuous than the tethers (e.g., tether 118) that connect the behind-the-ear portions of RIC hearing instruments to the in-ear portions of RIC hearing instruments. To support the different needs and preferences of different users, many hearing instrument manufacturers offer ranges of hearing instruments that include both BTE hearing instruments and RIC hearing instruments.

As shown in the example of FIG. 1, battery 110 of BTE hearing instrument 100 and battery 116 of RIC hearing instrument 102 are enclosed within the most-posterior locations of housing 104 and housing 112. Housing 104 and housing 112 may each be equipped with battery bay doors that may be opened to remove and replace batteries 110, 116. In this disclosure, user of directional terms such as "anterior," "posterior," "lateral," "medial," etc. with respect to as device (such as BTE hearing instrument 100) is consistent with direction on the body of a user when the device is properly worn by the user.

For a variety of reasons, it is advantageous to locate the battery bay doors near the posterior ends of housings 104, 112. For example, locating the battery bay doors near the posterior ends of housing 104, 112 may mean that components (e.g., circuitry, antennas, etc.) of BTE hearing instrument 100 and RIC hearing instrument 102 do not need to be designed with apertures that allow passage of batteries 110, 116 through the components. In another example, locating the battery bay doors near the posterior ends of housing 104, 112 may obviate the need for housings 104, 112 to include mid-section hinges or gaps that allow for removal and replacement of batteries 110, 116. Removing and replacing batteries 110, 116 has been considered necessary because batteries 110, 116 are typically not designed to be rechargeable.

In another example, batteries 110, 116 are typically zinc-air batteries. Zinc-air batteries require access to air. By positioning zinc-air batteries at the most-posterior portion of housings 105, 112, housings 105, 112 may define air-access channels to compartments that house batteries 110, 116. However, such air-access channels may also provide a route for water intrusion. If such air-access channels were defined for zinc-air batteries located in the mid-sections of housing 104, 112, such air-access channels may provide routes for water intrusion into cavities defined by housings 104, 112 that contain processing circuitry 106, 114. Water intrusion may damage processing circuitry 106, 114. In contrast, the compartments that house batteries 110, 116 may be isolated from the cavities that contain processing circuitry 106, 114. Thus, water intrusion into the cavities that contain batteries 110, 116 is less likely to damage hearing instruments 100, 102.

However, as appreciated in this disclosure, positioning batteries 110, 116 at the most-posterior locations of housings 104, 112 may have several drawbacks. For example, it is a desirable for processing circuitry 106, 114 to be the same in both BTE hearing instrument 100 and RIC hearing instrument 102. Reductions in design and manufacturing costs may be achieved by having processing circuitry 106, 114 be the same in both BTE hearing instrument 100 and RIC hearing instrument 102. Because receiver 108 of BTE hearing instrument 100 is located near the front (anterior) end of housing 104, processing circuitry 106 of BTE hearing instrument 100 is designed to accommodate receiver 108. However, as shown in FIG. 1, using the same processing circuitry in both BTE hearing instrument 100 and RIC hearing instrument 102 may result in undesirable wasted space 122 in RIC hearing instrument 102.

This disclosure describes BTE hearing instruments with receivers positioned posterior to batteries. Rechargeable batteries, such as lithium-ion batteries, do not need to be removed or replaced and do not need to have access to air. It is therefore realized in this disclosure that it is not necessary to position the batteries at the most-posterior locations of BTE hearing instruments. Rather, as described in this disclosure, the receivers of BTE hearing instruments may be positioned posterior to the batteries.

Figure 2:
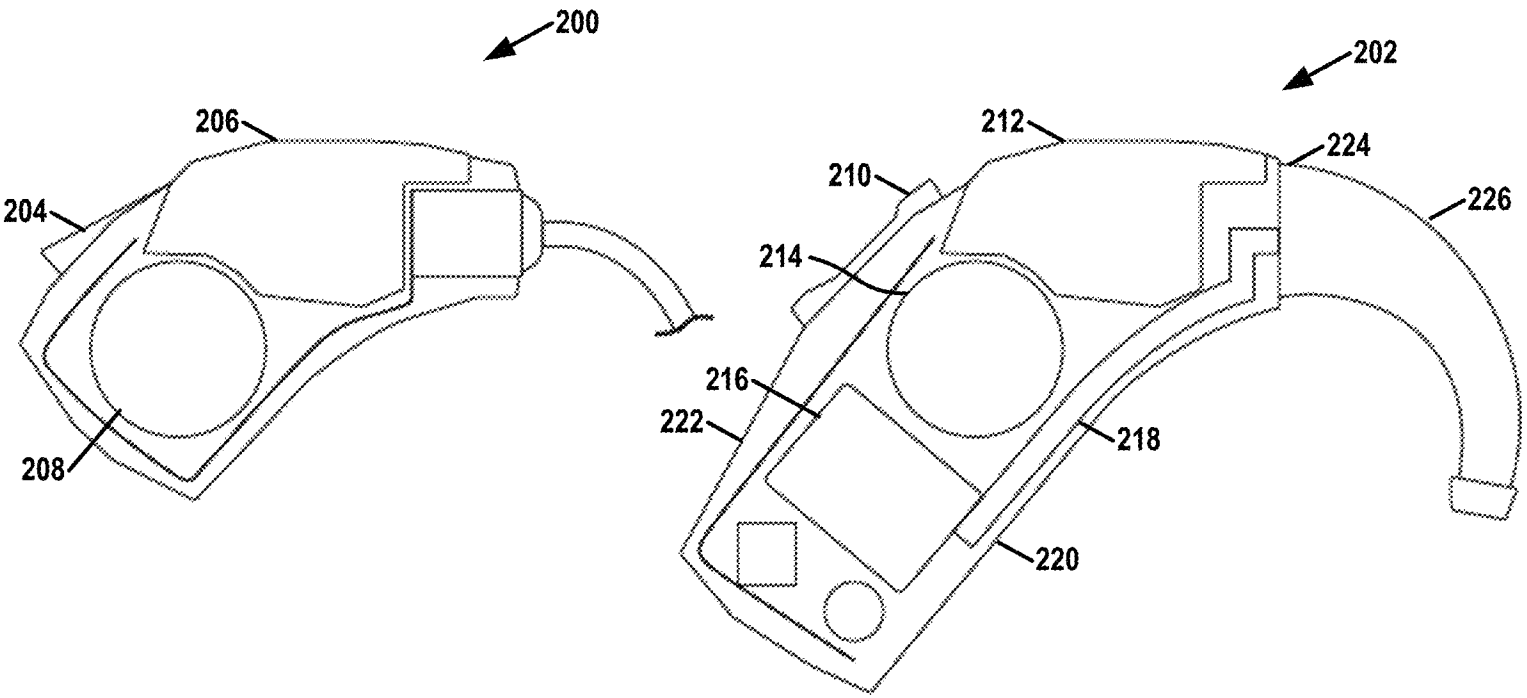
FIG. 2 is a conceptual diagram of a RIC hearing instrument and a BTE hearing instrument implemented in accordance with one or more aspects of this disclosure.

FIG. 2 is a conceptual diagram of a RIC hearing instrument 200 and a BTE hearing instrument 202 implemented in accordance with one or more aspects of this disclosure. A housing 204 of RIC hearing instrument 200 contains processing circuitry 206 and a battery 208. A housing 210 of BTE hearing instrument 202 contains processing circuitry 212, a battery 214, a receiver 216, and a tube 218. Housing 204, 210 may be made from an injection-molded material, such as a plastic.

In some examples, housing 210 defines tube 218. For instance, housing 210 may be molded to define tube 218. In other examples, tube 218 is a separate component contained within housing 210. In the example of FIG. 2, tube 218 is positioned along the inside of a lower surface 220 (i.e., the "belly") of housing 210. In other examples, tube 218 may be positioned elsewhere in housing 210, such as along a top surface 222 of housing 210, or a lateral surface of housing 210.

As shown in the example of FIG. 2. receiver 216 of BTE hearing instrument 202 is positioned posterior to battery 214 in housing 210. Tube 218 guides sound output by receiver 216 to an anterior tip 224 of BTE hearing instrument 202. The sound may then pass through a passage defined within an ear-hook 226 to a tube (not shown) that guides the sound into an ear canal of a user of BTE hearing instrument 202.

Positioning receiver 216 posterior to battery 214 in BTE hearing instrument 202, as opposed to a conventional arrangement shown in FIG. 1 in which battery 110 is positioned posterior to receiver 108, may have several advantages. For example, by positioning receiver 216 posterior to battery 214 in BTE hearing instrument 202, common processing circuitry can be used in both RIC hearing instrument 200 and BTE hearing instrument 202 without needing to shape the processing circuitry to accommodate the receiver. Thus, as shown in the example of FIG. 2, processing circuitry 206 of RIC hearing instrument 200 and processing circuitry 212 of BTE hearing instrument 202 may have the same shape. The common processing circuitry may be shaped in a way that reduces wasted space in RIC hearing instrument 200. Note that in FIG. 2, wasted space 122 is not present in RIC hearing instrument 200. By eliminating wasted space 122. housing 204 of RIC hearing instrument 200 may be made smaller without reducing the functionality of RIC hearing instrument 200.

The speakers within a receiver (e.g., receiver 108 of FIG. 1 or receiver 216 of FIG. 2) include wire coils. When an electric current passes through the wire coils, electromagnetic fields are produced that drive pistons that, in turn, vibrate membranes. Vibrations of the membranes generate soundwaves by moving air BTE hearing instruments 100 and 202 include microphones that detect sound. In some examples, the microphones include a diaphragm that acts as one plate of a capacitor. The diaphragm is moved by soundwaves in the air, which changes capacitance of the capacitor. Changes in the capacitance of the capacitor are ultimately transformed into an electrical signal corresponding to the soundwaves. When the receiver is too close to the microphones, vibrations caused by movement of the piston and membranes of the speakers may move the diaphragm of the microphones, which may cause unwanted audible artifacts, such as feedback loops. To prevent vibrations from the receiver causing audible artifacts, hearing instruments conventionally include specific components particularly for shielding the microphones from vibrations caused by the receiver. In other words, a "suspension" or "can" for the receiver is used to prevent such interference. Moreover, electromagnetic fields produced by the speakers in a receiver may affect other transducers in a hearing instrument, such as a telecoil or a near-field magnetic induction coil of the hearing instrument.

However, in accordance with one or more aspects of this disclosure, receiver 216 of BTE hearing instrument 202 is positioned posterior to battery 214. Thus, receiver 216 may be far enough away from the microphones of BTE hearing instrument 202 that there may be no need for specific components, such as a suspension or can, to shield the microphones from vibrations generated by receiver 216. Moreover, receiver 216 may be far enough away from certain transducers of BTE hearing instruments that there is no need for specific components to shield the transducers from electromagnetic fields generated by receiver 216. Eliminating specific components to shield the microphones from vibrations and/or electromagnetic fields generated by receiver 216 may allow further reduction in the size of BTE hearing instrument 202. Moreover, in some examples, because battery 214 is positioned between receiver 216 and the microphones of BTE hearing instrument 202, battery 214 itself may shield the microphones from vibrations generated by receiver 216. In other words, in some examples of this disclosure, the battery of a BTE hearing instrument (such as BTE hearing instrument 202) may shield the microphone from vibrations generated by the receiver.

As noted above, tube 218 is configured to direct sound output by receiver 216 to anterior tip 224 of BTE hearing instrument 202. From there, sound may travel through hook 226 and a tube to the ear canal of the user of BTE hearing instrument 202. Because receiver 216 is located near the posterior end of BTE, hearing instrument 202, the total distance that sound travels from receiver 216 to a tympanic membrane of the user may be greater than when the receiver is located closer to the anterior tip of a BTE hearing instrument, as is the case with BTE hearing instrument 100 of FIG. 1. Thus, the effective length of a tube running from receiver 216 to the tympanic membrane of the user is greater. As a result, the user may perceive a primary resonance peak of sounds output by receiver 216 to be shifted to a lower frequency. Shifting the primary resonance peak to a lower frequency may be desirable for users with more profound hearing loss. This is because users with more profound hearing loss tend to lose more hearing sensitivity for sounds at higher frequencies. Thus, shifting the primary resonance peak to a lower frequency may enable such users to better perceive sounds at particular frequencies.

In some examples, tube 218 has a circular cross-sectional profile. In other examples, tube 218 has a cross-sectional profile of a flattened circle, such as an oval or ellipse. The flattened circle may the same cross-sectional area as the circle. However, the flattened surfaces of tube 218 may increase resistance (i.e., peak damping) without the need for including a discrete damper. Excluding a discrete damper from BTE hearing instrument 202 may further decrease size and complexity of BTE hearing instrument 202.

Positioning receiver 216 posterior to battery 214 in BTE hearing instruments may also enable both RIC hearing instruments and BTE hearing instruments to be more modular. In other words. common components can be used in more types of BTE hearing instruments and RIC hearing instruments.

Figure 3B:
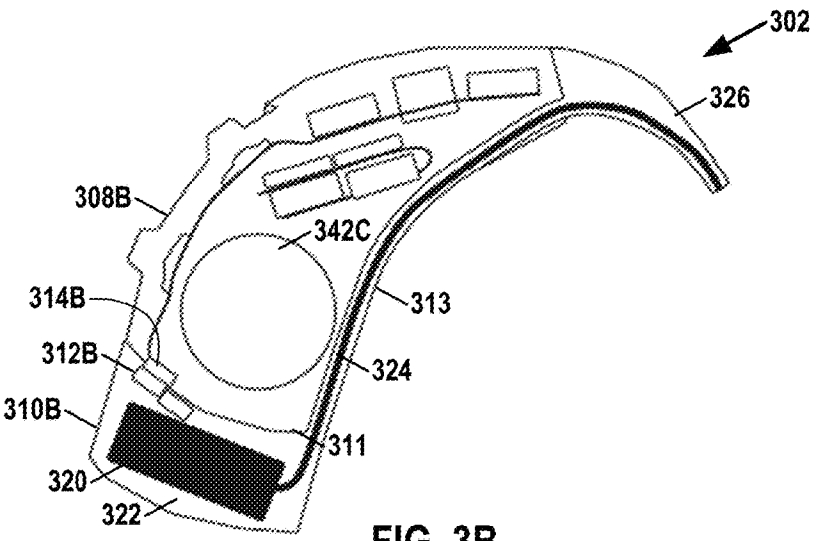
FIG. 3A, FIG. 3B, FIG. 3C, and FIG. 3D are conceptual diagrams illustrating example hearing instruments implemented according to aspects of this disclosure.
Figure 3D:
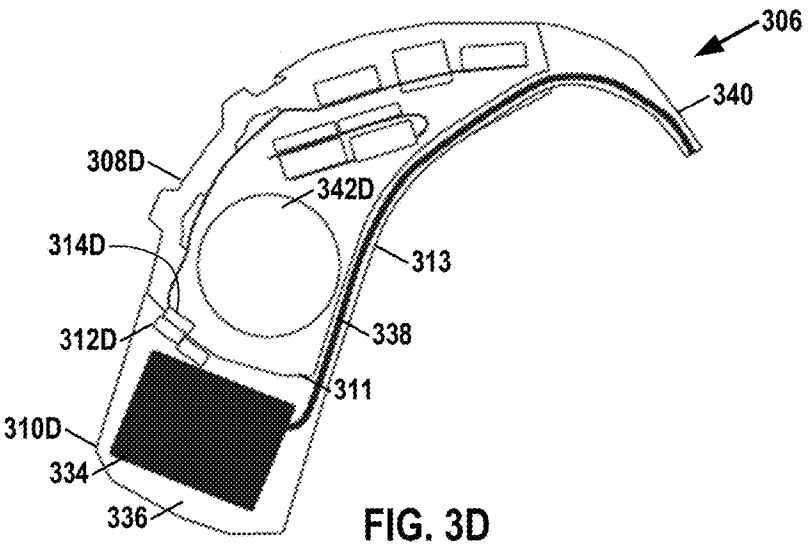
Figure 3A:
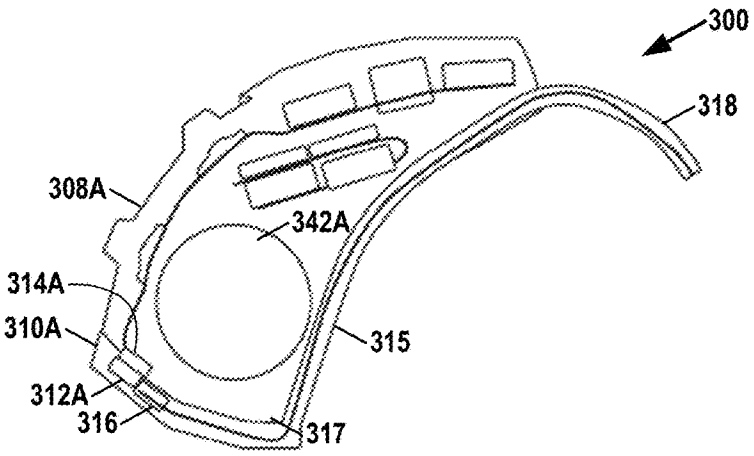
Figure 3C:
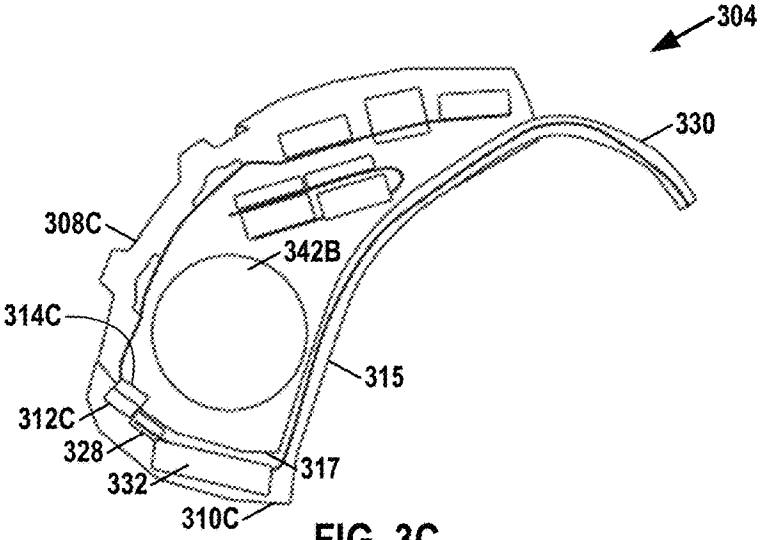

FIG. 3A, FIG. 3B, FIG. 3C, and FIG. 3D are conceptual diagrams illustrating example hearing instruments implemented according to aspects of this disclosure. FIG. 3A illustrates a RIC hearing instrument 300, FIG. 3B illustrates a BTE hearing instrument 302, FIG. 3C illustrates a RIC hearing instrument 304, and FIG. 3D illustrates a power BTE hearing instrument 306. RIC hearing instrument 300, BTE hearing instrument 302, RIC hearing instrument 304, and power BTE hearing instrument 306 include a common processing module 308A, 308B, 308C, and 308D, respectively. This disclosure may refer to processing module 308A, 308B, 308C, and 308D collectively as "processing modules 308." Housings of each of processing modules 308 may be the same size and shape. The housings of each of processing modules 308 contain the same internal components. For instance, each of processing modules 308 may include an instance of the same processing circuitry, microphones, battery, and other internal components.

In the example of FIG. 3A, RIC hearing instrument 300, BTE hearing instrument 302, RIC hearing instrument 304, and power BTE hearing instrument 306 include a body module 310A, 310B, 310C, and 310D, respectively. This disclosure may refer to body modules 310A, 310B, 310C, and 310D collectively as "body modules 310." Each of body modules 310 may be shaped to attach to processing modules 308. For instance, each of body modules 310 may be shaped to cover a posterior end and a belly of a hearing instrument. In other words, a BTE body module (e.g., body modules 310B, 310D) may be positioned on an inferior-anterior surface 311 and an inferior-posterior surface 313 of a processing module (e.g., processing modules 308C, 308D) when the BTE body module is mated with the processing module. Similarly, a RIC body module (e.g., body modules 310A, 310C) may be positioned on the inferior-anterior surface 315 and the inferior-posterior surface 317 of the processing module (e.g., processing modules 308A, 308C) when the RIC body module is mated with the processing module.

Housings of processing modules 308 may be coupled to housings of body modules 310. In some examples, the housings of processing modules 308 may configured to be user-detachable from housings of body modules 310.

Body modules 310 includes a set of one or more contact pins 312A, 312B, 312C, 312D, respectively, (collectively, "contact pins 312"). Contact pins 312 are positioned to interface with or otherwise contact corresponding contact pins 314A, 314B, 314C, 314D, respectively, of processing modules 308. This disclosure may refer collectively to contact pins 314A, 314B, 314C, and 314D as "contact pins 314." The number and arrangement of contact pins 312 may be the same for each of body modules 310. Processing modules 308 transmit data to body modules 310 via contact pins 312, 314, and vice versa. In some examples, contact pins 312, 314 may transmit electrical power from the batteries within processing modules 308 to components within body modules 310. In this disclosure, "contact pins" may take the form of pins, pads, or other types of surfaces for making contact.

Body modules 310 may include different components. For example, the body module 310A of RIC hearing instrument 300 includes a connector 316 for a RIC cable 318 that connects to an in-car portion of RIC hearing instrument 300 (not shown). Body module 310B of BTE hearing instrument 302 includes a receiver 320 and a housing 322 of body module 310B defines a tube 324 and an ear-hook 326. A tube running to an ear canal of a user may be attached to a lip of ear-hook 326. Sound output by receiver 320 may travel through tube 324, ear-hook 326, and the tube running to the ear canal of the user.

Body module 310C of RIC hearing instrument 304 includes a connector 328, a RIC cable 330, and a telecoil 332. Telecoil 332 may receive and/or send wireless signals from an external device, such as a telephone or a media streaming device. Body module 3100 may transmit signals received by telecoil 332 to processing module 308C for further processing. In some examples, signals received by telecoil 332 may be directly signaled on RIC cable 330 to an in-ear portion of RIC hearing instrument 304.

Body module 310D of power BTE hearing instrument 306 includes a receiver 334. A housing 336 of body module 310D defines a tube 338 and an ear-hook 340, A tube running to an ear canal of a user may be attached to a lip of ear-hook 340. Sound output by receiver 334 may travel through tube 338, ear-hook 340, and the tube running to the ear canal of the user. Receiver 334 may be larger and more powerful than receiver 320, enabling receiver 334 to generate louder sounds than receiver 320. Thus, a heating device equipped with body module 310D may be more appropriate for users with more profound hearing loss than a hearing device equipped with body module 310B.

As shown in the examples of FIG. 3A through FIG. 3D, hearing instruments 300, 302, 304, and 306 include batteries 342A, 342B, 342C, and 342D, respectively. This disclosure may refer to batteries 342A, 342B, 342C, and 342D collectively as batteries 342. As shown in the examples of FIGS. 3B and 3D, receivers 320, 334 are posterior to batteries 342B, 342D. Furthermore, in the examples of FIG. 3A through FIG. 3D, as well as other examples of this disclosure, processing modules (e.g., processing modules 308) may include batteries (e.g., batteries 342).

Figure 4A:
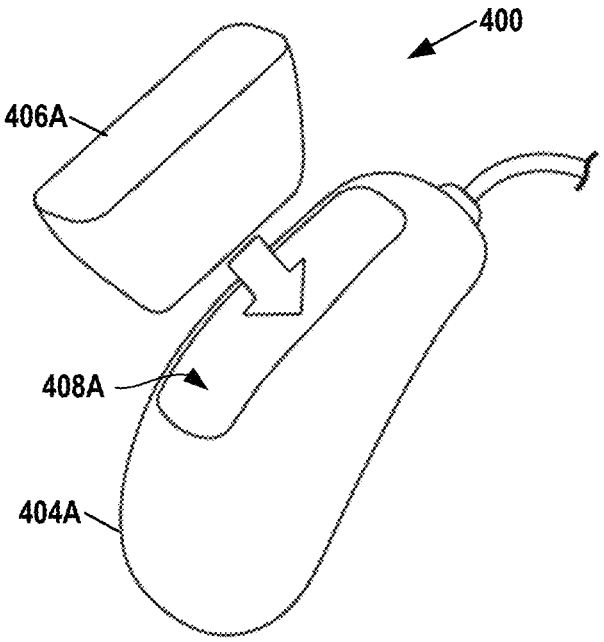
FIG. 4A and FIG. 4B are conceptual diagrams illustrating an example Receiver-In-Canal (RIC) hearing instrument and an example Behind-the-Ear (BTE) hearing instrument, in accordance with one or more techniques of this disclosure.
Figure 4B:
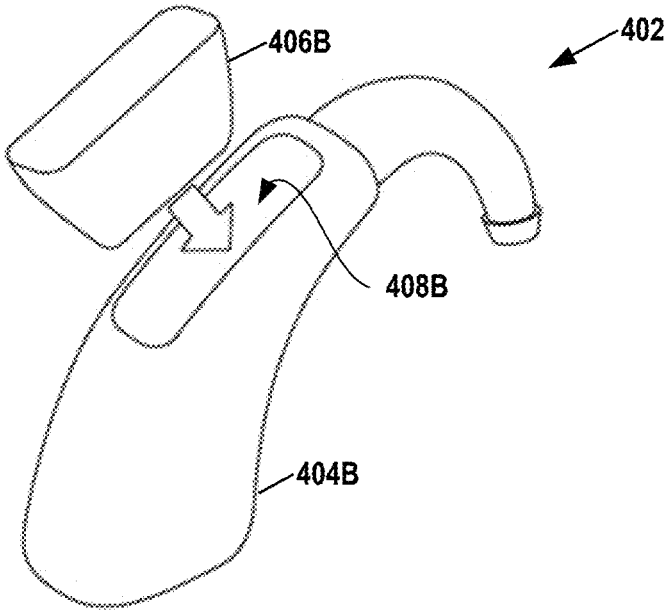

FIG. 4A and FIG. 4B are conceptual diagrams illustrating an example RIC hearing instrument 400 and an example BTE hearing instrument 402, in accordance with one or more techniques of this disclosure. In the example of FIG. 4A, RIC hearing instrument 400 includes a body module 404A and a processing module 406A. Similarly, in the example of FIG. 4B, BTE hearing instrument 402 includes a body module 404B and a processing module 406B.

Body modules 404A, 404B (collectively, "body modules 404") have housings that define recesses 408A, 408B, respectively. Recesses 408A, 408B (collectively, "recesses 408") may each be the same size and shape. Recesses 408A, 408B are sized and shaped to receive processing modules 406A, 406B. Furthermore, the housings of body modules 404 may include various components. For example, the housing of body module 404B may include a receiver, the housings of either of body modules 404 may include telecoils, the housings of either of body modules 404 may include one or more microphones, power sources, communication units (e.g., near field magnetic induction (NFMI) communication systems), push buttons, and other types of components. Thus, the body module 404A for RIC hearing instrument 400 may include different components than the body module 404B for BTE hearing instrument 402. For example, body module 404A may include components for attachment of a RIC cable.

Processing modules 406A, 406B (collectively, "processing modules 406") each include a housing that contains processing circuitry. The processing circuitry may process sound signals, sensor data, and/or perform various other processing functions. In some examples, processing modules 406 may each include one or more microphones, storage devices, sensors, power sources, communication units, and other types of components. In some examples, processing modules 406 may include components for attachment of a RIC cable. Thus, in such examples, processing modules 406 may be used with body modules 404, but it may not be necessary to use a body module for processing modules 406 to serve as behind-the-ear portions of RIC hearing instruments. Processing modules 406 may have different shapes than those shown in the examples of FIG. 4A and FIG. 4B.

Processing modules 406 may include the same components and may be used interchangeably between body module 404A and body module 404B. Thus, the same one of body modules 404 may be used in different body modules 404A, 404B of RIC hearing instrument 400 and BTE hearing instrument 402. For instance, processing module 406A may be used in body module 404B and processing module 406B may be used in body module 404A. The housings of each of processing modules 406 may have the same size and shape. The housings of each of processing modules 406 may be formed to fit into recesses 408. In other words, recesses 408A, 408B are both shaped to accommodate insertion of the processing module. Although shown as indented portions defined in body modules 404 such that processing modules 406 are enclosed on three sides, recesses 408 can have other shapes. For instance, the housings of body modules 404 can be defined such that processing modules 406 are exposed on two or more sides. Moreover, although recesses 408 are shown as being at the top of body modules 404, recesses 408 may be defined in other sides of body modules 404 (e.g., medial, lateral, bottom, etc.).

In some examples where processing modules 406 include one or more microphones, the housings of processing modules 406 and the housings of body modules 404 may have shapes that define partial gaps between the housings, which may allow sound to reach the microphones. In such examples, portions of the housings of processing modules 406 may partially cover such gaps, e.g., to reduce water and dust intrusion to the microphones.

Processing modules 406 may have contact surfaces (e.g., contact pins, contact pads, etc.) that engage contact surfaces (e.g., contact pins, contact pads, etc.) of body modules 404. The contact surfaces of body modules 404 may be located within recesses 408, The contact surfaces of body modules 404 and processing modules 406 may enable body modules 404 and processing modules 406 to exchange power and/or data. The positions, types, and number of the contact surfaces (e.g., pins, pads, etc. may be standard among body modules 404 and processing modules 406. Thus, processing modules 406 may be swapped among body modules 404. The contact surfaces of processing modules 406 and the contact surfaces of body modules 404 may be located at various positions. For instance, in some examples, the contact surfaces of processing modules 406 can be located on superior surfaces of processing modules 406, which may reduce the chances of water dripping downward to the contact pins. In other examples, the contact surfaces of processing modules 406 may be located at posterior or lower surfaces of processing modules 406.

The housings of processing modules 406 (and other processing modules of this disclosure) may be sealed to resist water and dust intrusion into processing modules 406. For instance, processing modules may be sealed separately from BTE body modules (or the housings thereof) and/or RIC body modules (or the housings thereof) to resist water intrusion into the processing modules. Because processing modules 406 may include sensitive electronics that are susceptible to water and dust damage, sealing processing modules 406 may prevent damage to such sensitive components, which are commonly the most expensive parts of hearing instruments. Furthermore, the modular design of RIC hearing instrument 400 and BTE hearing instrument 402 may facilitate repair. For instance, if a component of a body module is damaged, it may be easier to simply replace the body module while keeping the processing module, or vice versa.

In some examples, processing modules 406 may be removably inserted into recesses 408. Inserting processing modules 406 into recesses 408 may involve pushing processing modules 406 straight into recesses 408, performing a swivel motion to insert processing modules 406 into recesses 408, or performing other motions to insert processing modules 406 into recesses 408, In some examples, an end-user of RIC hearing instrument 400 or BTE hearing instrument 402 may insert and remove processing modules 406 into body modules 404. For instance, in examples where processing modules 406 include power sources, such as batteries, the end-user may remove a first processing module from a body module, insert the first processing module into a charging station for recharging of the power source of the first processing module, and insert a second, fully charged processing module into the same body module, and continue use of the hearing instrument while the power source of the first processing module is recharging.

In another example, a user may have multiple body modules for different situations. For instance, in one example, the user may have a RIC-style body module for day-to-day use and a BTE-style body module for situations where the user may need more help hearing, such as in busy restaurants or sporting events. In another example, the user may have different body modules that include different types of sensors. Because the user can use the same processing module with different body modules, all of the user's settings may remain stored in the processing module regardless of the style or type of body module the user chooses. In some examples, there can be different colors of body modules, e.g., to fit the style, skin tone, etc., of the user.

In some examples, processing modules 406 may be inserted into recesses 408 during a manufacturing stage or a fitting stage. In some such examples, processing modules 406 may thereafter remain permanently in recesses 408.

Thus, in the example of FIG. 4A and other examples of this disclosure, body module 404A may be considered a RIC body module and body module 404B may be considered a BTE body module. Similarly, with respect to the examples of FIG. 3A-3D, body modules 310A, 310C may be RIC body modules; body modules 310B and 310D may be BTE body modules; and processing modules 308A-308D may be processing modules. In some examples, a kit that may be used for assembling hearing instruments may include a processing module, a BTE body module and a RIC body module. In this example, the processing module may include processing circuitry and processing module contact pins (e.g., contact pins 314). In this example, the BTE body module may include first body module contact pins (e.g., contact pins 312B, 312D) arranged to contact the processing module contact pins when the BTE body module is mated with the processing module. The BTE, body module also includes a receiver (e.g., receiver 320, 334) configured to produce sound based on signals received from the processing module via the processing module contact pins and the first body module contact pins. A tube (e.g., tube 324, 338) of the BTE body module directs the sound and the receiver is posterior to a battery that provides power to the processing module when the BTE body module is mated with the processing module. In this example, a RIC body module comprises second body module contact pins (e.g., contact pins 312A, 312C) arranged to contact the processing module contact pins when the RIC body module is mated with the processing module. The RIC body module may also include a cable configured to transmit electrical signals from the processing module via the processing module contact pins and the second body module contact pins.

Figure 5A:
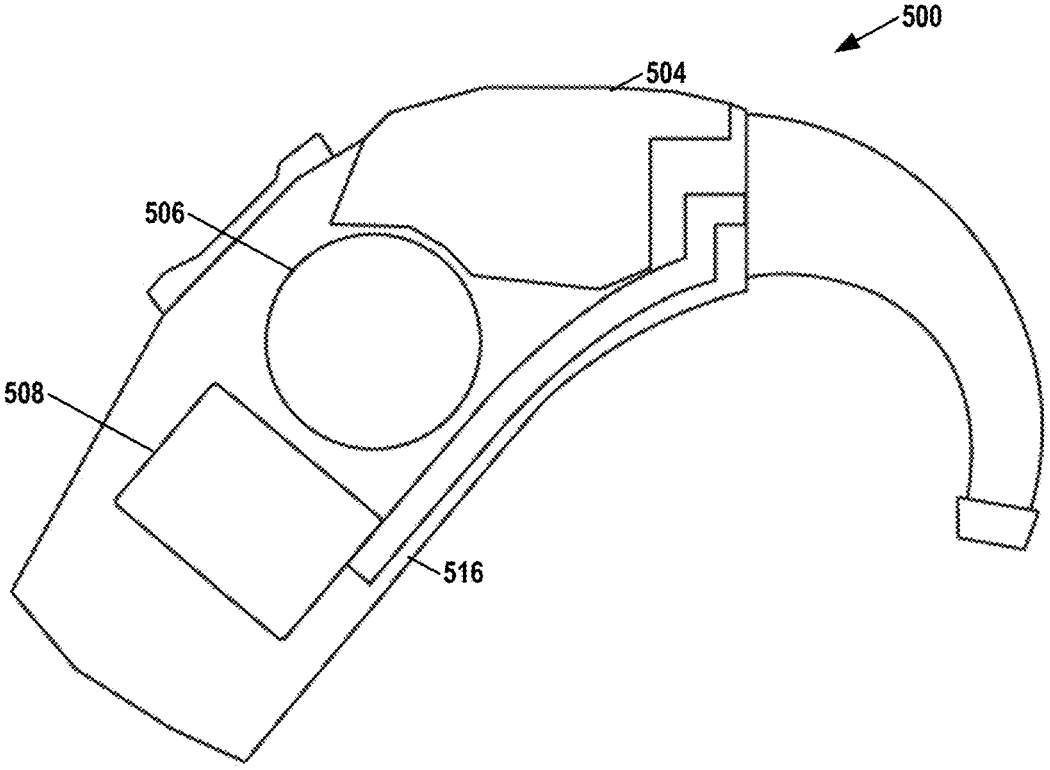
FIG. 5A and FIG. 5B are conceptual diagrams illustrating BTE hearing instruments in which receivers are oriented in different directions, in accordance with one or more techniques of this disclosure.
Figure 5B:
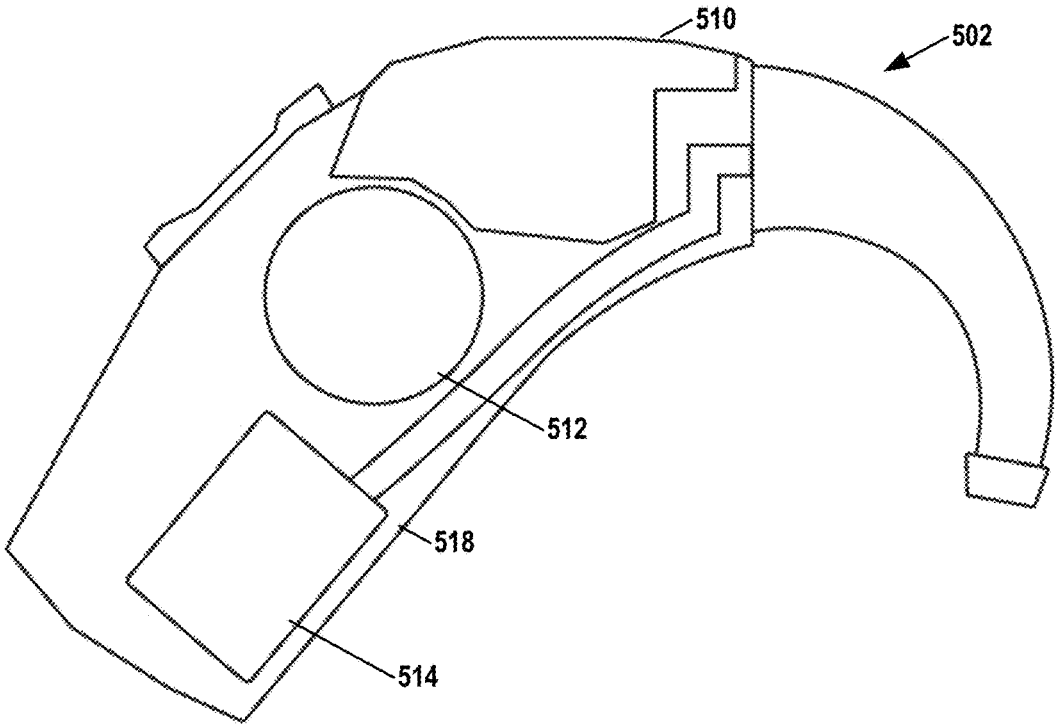

FIG. 5A and FIG. 5B are conceptual diagrams illustrating BTE hearing instruments 500, 502 in which receivers are oriented in different directions, in accordance with one or more techniques of this disclosure. BTE hearing instrument 500 includes circuitry 504, a battery 506, and a receiver 508. BTE heating instrument 502 includes circuitry 510, a battery 512, and a receiver 514. In the example of FIG. 5A, receiver 508 of BTE hearing instrument 500 has a spout oriented toward a belly 516 of BTE hearing instrument 500. In the example of FIG. 5B, receiver 514 of BTE hearing instrument 502 has a spout oriented toward a belly 518 of BTE hearing instrument 502. The spout of a receiver is an aperture through which sound produced by speakers of the receiver passes out of the receiver.

Figure 6:
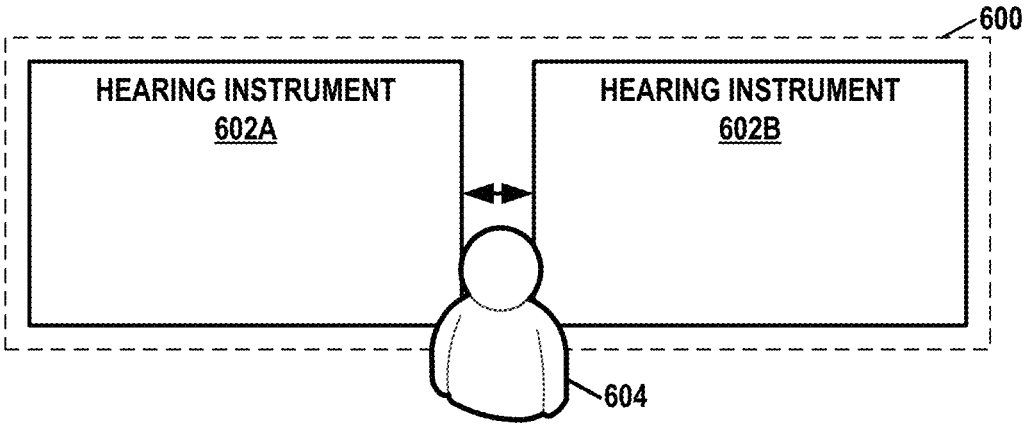
FIG. 6 is a conceptual diagram illustrating an example system that includes hearing instruments, in accordance with one or more techniques of this disclosure.

FIG. 6 is a conceptual diagram illustrating an example system 600 that includes hearing instruments 602A, 602B, in accordance with one or more techniques of this disclosure. This disclosure may refer to hearing instruments 602A and 6028 collectively, as "hearing instruments 602." Hearing instruments 602 may be examples of the hearing instruments shown in FIGS. 2A-5B. A user 604 may wear hearing instruments 602. In some instances, such as when user 604 has unilateral hearing loss, user 604 may wear a single hearing instrument. In other instances, such as when user 604 has bilateral hearing loss, the user may wear two hearing instruments, with one hearing instrument for each ear of user 604.

Hearing instruments 602 may comprise one or more of various types of devices that are configured to provide auditory stimuli to a user and that are designed for wear and/or implantation at, on, or near an ear of the user. Hearing instruments 602 may be worn, at least partially, in the ear canal or concha. One or more of hearing instruments 602 may include behind the ear (BTE) components that are worn behind the ears of user 604. In some examples, hearing instruments 602 comprise devices that are at least partially implanted into or integrated with the skull of the user. In some examples, one or more of hearing instruments 602 is able to provide auditory stimuli to user 604 via a bone conduction pathway.

In any of the examples of this disclosure, each of hearing instruments 602 may comprise a hearing assistance device. Hearing assistance devices include devices that help a user hear sounds in the user's environment. Example types of hearing assistance devices may include hearing aid devices, Personal Sound Amplification Products (PSAPs), cochlear implant systems (which may include cochlear implant magnets, cochlear implant transducers, and cochlear implant processors), and so on. In some examples, hearing instruments 602 are over-the-counter, direct-to-consumer, or prescription devices. Furthermore, in some examples, hearing instruments 602 include devices that provide auditory stimuli to the user that correspond to artificial sounds or sounds that are not naturally in the user's environment, such as recorded music, computer-generated sounds, or other types of sounds. For instance, hearing instruments 602 may include so-called "hearables," earbuds, earphones, or other types of devices. Some types of hearing instruments provide auditory stimuli to the user corresponding to sounds from the user's environmental and also artificial sounds.

In some examples, one or more of hearing instruments 602 may be BTE devices, which include a housing worn behind the ear contains all of the electronic components of the hearing instrument, including the receiver (i.e., the speaker). The receiver conducts sound to an earbud inside the ear via an audio tube. In some examples, one or more of hearing instruments 602 may be RIC hearing-assistance devices, which include a housing worn behind the ear that contains electronic components and a housing worn in the ear canal that contains the receiver.

Hearing instruments 602 may implement a variety of features that help user 604 hear better. For example, hearing instruments 602 may amplify the intensity of incoming sound, amplify the intensity of certain frequencies of the incoming sound, or translate or compress frequencies of the incoming sound. In another example, hearing instruments 602 may implement a directional processing mode in which hearing instruments 602 selectively amplify sound originating from a particular direction (e.g., to the front of the user) while potentially fully or partially canceling sound originating from other directions. In other words, a directional processing mode may selectively attenuate off-axis unwanted sounds. The directional processing mode may help users understand conversations occurring in crowds or other noisy environments. In some examples, hearing instruments 602 may use beamforming or directional processing cues to implement or augment directional processing modes.

In some examples, hearing instruments 602 may reduce noise by canceling out or attenuating certain frequencies. Furthermore, in some examples, hearing instruments 602 may help user 604 enjoy audio media, such as music or sound components of visual media, by outputting sound based on audio data wirelessly transmitted to hearing instruments 602.

Hearing instruments 602 may be configured to communicate with each other. For instance, in any of the examples of this disclosure, hearing instruments 602 may communicate with each other using one or more wirelessly communication technologies. Example types of wireless communication technology include Near-Field Magnetic Induction (NFMI) technology, a 900 MHz technology, a BLUETOOTH™ technology, a WI-FI™ technology, audible sound signals, ultrasonic communication technology, infrared communication technology, an inductive communication technology, or another type of communication that does not rely on wires to transmit signals between devices. In some examples, hearing instruments 602 use a 2.4 GHz frequency band for wireless communication. In examples of this disclosure, hearing instruments 602 may communicate with each other via non-wireless communication links, such as via one or more cables, direct electrical contacts, and so on.

In accordance with a technique of this disclosure, hearing instruments 602 may be BTE hearing instruments. Each of the BTE hearing instruments may include processing circuity, a battery that stores energy for use by the processing circuitry, and a housing that contains a receiver configured to output sound. The receiver is positioned within the heating instrument posterior to the processing circuitry and the power source.

Figure 7:
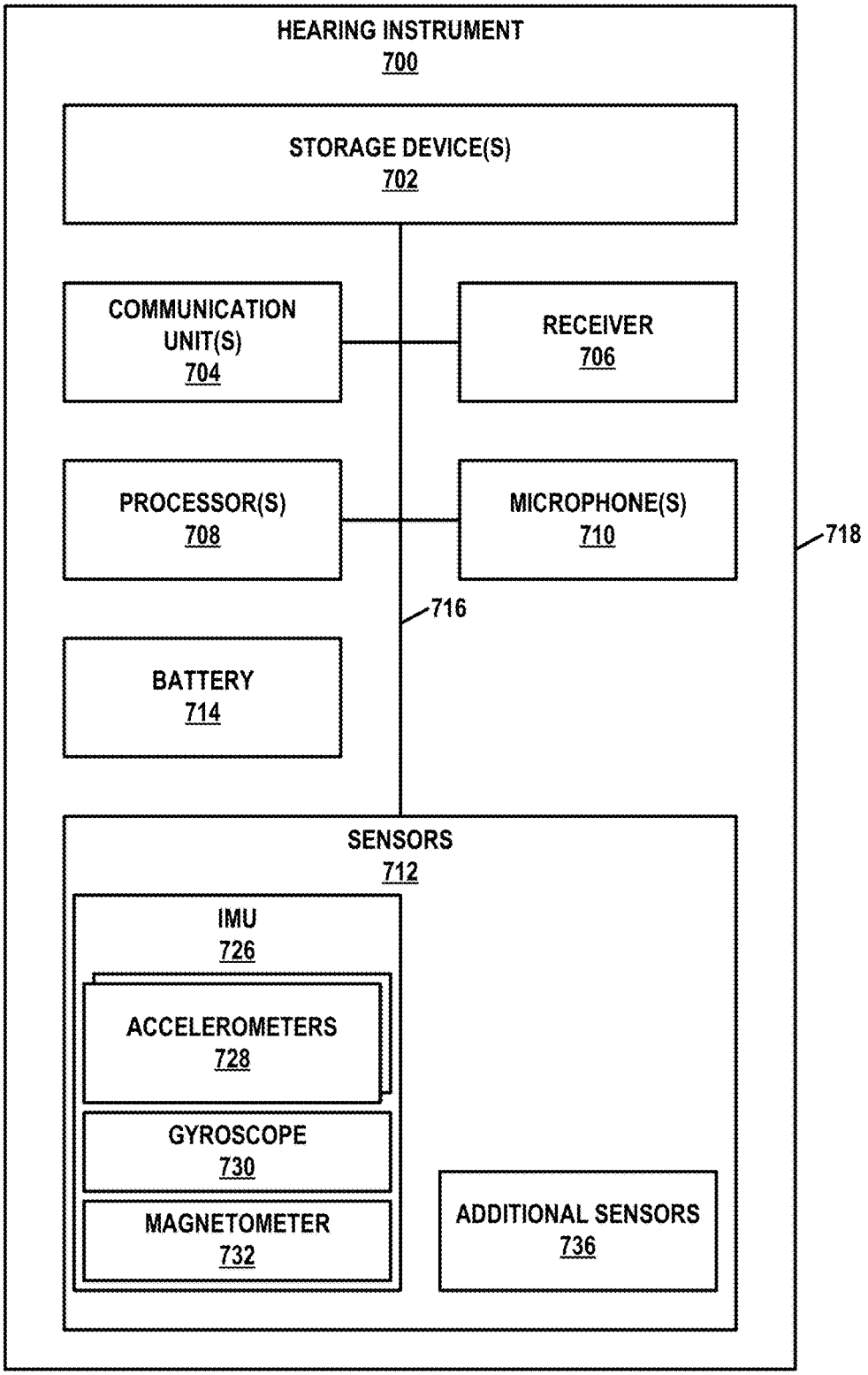
FIG. 7 is a block diagram illustrating example components of a hearing instrument, in accordance with one or more aspects of this disclosure.

FIG. 7 is a block diagram illustrating example components of hearing instrument 700, in accordance with one or more aspects of this disclosure. Hearing instrument 700 may be either one of hearing instruments 602. In the example of FIG. 7, hearing instrument 700 comprises one or more storage devices 702, one or more communication unit(s) 704, a receiver 706, one or more processor(s) 708, one or more microphone(s) 710, a set of sensors 712, a battery 714, and one or more communication channels 716. Communication channels 716 provide communication between storage devices 702, communication unit(s) 704, receiver 706, processor(s) 708, a microphone(s) 710, and sensors 712. Components 702, 704, 706, 708, 710, and 712 may draw electrical power from battery 714.

In the example of FIG. 7, each of components 702, 704, 706, 708, 710, 712, 714, and 716 are contained within a single housing 718 (e.g., hearing instrument 700 may be a BTE hearing instrument, such as BTE hearing instrument 202 (FIG. 2), BTE hearing instrument 302 (FIG. 3B), or power BTE hearing instrument 306 (FIG. 3D)). However, in other examples of this disclosure, components 702, 704, 706, 708, 710, 712, 714, and 716 may be distributed among two or more housings. For instance, in an example where hearing instrument 700 is a RIC device, such as RIC hearing instrument 200 (FIG. 2), RIC hearing instrument 300 (FIG. 3A), or RIC hearing instrument 304 (FIG. 3C), receiver 706 and one or more of sensors 712 may be included in an in-ear housing separate from a behind-the-ear housing that contains the remaining components of hearing instrument 700. In such examples, a RIC cable may connect the two housings.

Furthermore, in the example of FIG. 7, sensors 712 include an inertial measurement unit (IMU) 726 that is configured to generate data regarding the motion of hearing instrument 700. BTU 726 may include a set of sensors. For instance, in the example of FIG. 7, MU 726 includes one or more of accelerometers 728, a gyroscope 730, a magnetometer 732, combinations thereof, and/or other sensors for determining the motion of hearing instrument 700. Furthermore, in the example of FIG. 7, hearing instrument 700 may include one or more additional sensors 736. Additional sensors 736 may include a photoplethysmography (PPG) sensor, blood oximetry sensors, blood pressure sensors, electrocardiograph (EKG) sensors, body temperature sensors, electroencephalography (EEG) sensors, environmental temperature sensors, environmental pressure sensors, environmental humidity sensors, skin galvanic response sensors, and/or other types of sensors. In other examples, hearing instrument 700 and sensors 712 may include more, fewer, or different components.

Storage devices 702 may store data. Storage devices 702 may comprise volatile memory and may therefore not retain stored contents if powered off. Examples of volatile memories may include random access memories (RAM), dynamic random access memories (DRAM), static random access memories (SRAM), and other forms of volatile memories known in the art. Storage devices 702 may further be configured for long-term storage of information as non-volatile memory space and retain information after power on/off cycles. Examples of non-volatile memory configurations may include magnetic hard discs, optical discs, flash memories, or forms of electrically programmable memories (EPROM) or electrically erasable and programmable (EEPROM) memories.

Communication unit(s) 704 may enable hearing instrument 700 to send data to and receive data from one or more other devices, such as another hearing instrument, an accessory device, a mobile device, or another types of device. Communication unit(s) 704 may enable hearing instrument 700 using wireless or non-wireless communication technologies. For instance, communication unit(s) 704 enable hearing instrument 700 to communicate using one or more of various types of wireless technology, such as a BLUETOOTH™ technology, 3G, 4G, 4G LTE, 5G, ZigBee, WI-FI™, Near-Field Magnetic Induction (NFMI), ultrasonic communication, infrared (IR) communication, or another wireless communication technology. In some examples, communication unit(s) 704 may enable hearing instrument 700 to communicate using a cable-based technology, such as a Universal Serial Bus (USB) technology.

Receiver 706 comprises one or more speakers for generating audible sound. Microphone(s) 710 detects incoming sound and generates one or more electrical signals (e.g., an analog or digital electrical signal) representing the incoming sound.

Processor(s) 708 may be processing circuits configured to perform various activities. For example, processor(s) 708 may process the signal generated by microphone(s) 710 to enhance, amplify, or cancel-out particular channels within the incoming sound. Processor(s) 708 may then cause receiver 706 to generate sound based on the processed signal. In some examples, processor(s) 708 include one or more digital signal processors (DSPs). In some examples, processor(s) 708 may cause communication unit(s) 704 to transmit one or more of various types of data. For example, processor(s) 708 may cause communication unit(s) 704 to transmit data to computing system 608. Furthermore, communication unit(s) 704 may receive audio data from computing system 608 and processor(s) 708 may cause receiver 706 to output sound based on the audio data. Processor(s) 708 may be implemented as programmable circuitry and/or fixed-function circuitry.

In the example of FIG. 7, storage devices 702, communication unit(s) 704, processor(s) 708, and/or sensor 712 may comprise common processing circuitry among BTE hearing instruments and RIC hearing instruments. For instance, processing circuitry 206, 212, 504, 510 may include one or more of storage devices 702, communication unit(s) 704, processor(s) 708, sensors 712. Battery 714 may be positioned within housing 718 posterior to storage device (s) 702, communication unit(s) 704, receiver 706, processor (s) 708, microphone(s) 710, and sensors 712.

Figure 8:
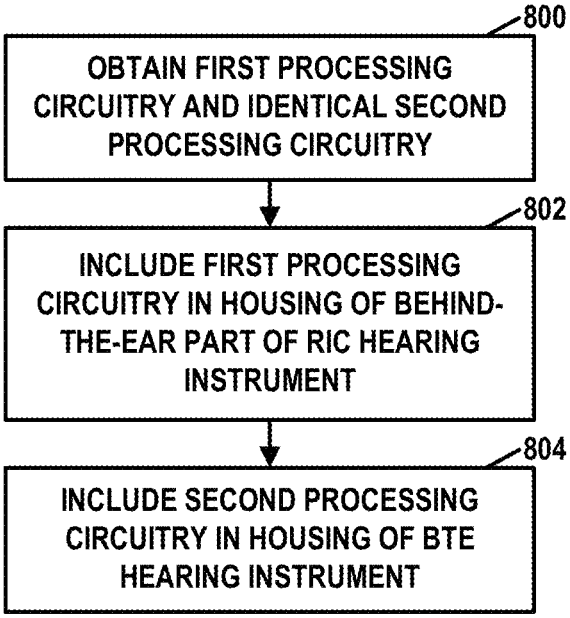
FIG. 8 is a flowchart illustrating an example operation of assembling hearing instruments, in accordance with one or more aspects of this disclosure.

FIG. 8 is a flowchart illustrating an example operation of assembling hearing instruments, in accordance with one or more aspects of this disclosure. Actions of this operation may be performed in different orders. Moreover, other examples may include more, fewer, or different actions.

In the example of FIG. 8, an assembler may obtain first processing circuitry and second, identical processing circuitry (e.g., processing circuitry 206 and processing circuitry 212 (FIG. 2); processing modules 406 (FIG. 4A and FIG. 4B); circuitry 504, 510; etc.) (800). The first processing circuitry is identical to the second processing circuitry. For instance, the first processing circuitry and the second processing circuitry may have the same components arranged and connected in the same way.

Furthermore, in the example of FIG. 8, the assembler may include the first processing circuitry in a housing of a behind-the-ear part of a RIC hearing instrument (e.g., RIC hearing instrument 200, RIC hearing instrument 300, RIC hearing instrument 304. RIC hearing instrument 400, etc.) (802).

The assembler may also include the second processing circuitry in a housing of a Behind-The-Ear (BTE) hearing instrument (e.g., BTE hearing instrument 202, BTE hearing instrument 302. power BTE hearing instrument 306, BTE hearing instrument 402, BTE hearing instrument 500, BTE hearing instrument 502, etc.) (804). The BTE hearing instrument is configured to include a receiver (e.g., receiver 216, receiver 320, receiver 334, receiver 508, receiver 514, etc.) posterior to a battery (e.g., battery 214, battery 506, battery 512, etc.) of the BTE hearing instrument and the second processing circuitry.

In some examples, the housing of the behind-the-ear part of the RIC hearing instrument is a first housing of the behind-the-ear part of the RIC hearing instrument. A first module of the RIC hearing instrument includes the first housing of the behind-the-ear part of the RIC hearing instrument and first contact pins. A second module of the RIC hearing instrument includes second contact pins and at least a segment of a cable that transmits signals from the first module of the RIC hearing instrument to an in-ear part of the RIC hearing instrument. The housing of the BTE hearing instrument is a first housing of the BTE hearing instrument. A first module of the BTE hearing instrument includes the first housing of the BTE hearing instrument and third contact pins. A second module of the BTE hearing instrument includes a second housing of the BTE hearing instrument and fourth contact pins. The second housing of the BTE hearing instrument includes the receiver. The receiver may receive signals from the processing circuitry via the third and fourth contact pins.

The following is a non-limiting list of examples that may be in accordance with one or more techniques of this disclosure.

Example 1: A Behind-The-Ear (BTE) hearing instrument comprising: processing circuity; a battery that stores energy for use by the processing circuitry; and a housing that contains a receiver configured to output sound, wherein the receiver is positioned within the hearing instrument posterior to the processing circuitry and the power source.

Example 2: The BTE hearing instrument of example 1, wherein: the BTE hearing instrument further comprises a microphone, and the battery shields the microphone from vibrations generated by the receiver.

Example 3: The BTE hearing instrument of any of examples 1-2, wherein: the BTE hearing instrument further comprises a transducer, and the battery shields the transducer from electromagnetic fields generated by the receiver.

Example 4: The BTE hearing instrument of any of examples 1-3, wherein: the housing is a first housing, a second housing contains the processing circuitry, the first housing is coupled to the second housing.

Example 5: The BTE hearing instrument of example 4, wherein: the second housing is sealed to resist water intrusion into the second housing.

Example 6: The BTE hearing instrument of any of examples 4-5, wherein: a first module includes the first housing and first contact pins, a second module includes the second housing and second contact pins, the first contact pins are positioned to contact the second contact pins, the receiver receives signals from the processing circuitry via the first and second contact pins.

Example 7: The BTE hearing instrument of any of examples 4-6, wherein the first housing and second housing are configured to be user-detachable.

Example 8: The BTE hearing instrument of any of examples 4-7, wherein the first housing is positioned on an inferior-anterior surface and an inferior-posterior surface of the second housing when the second housing is mated with the first housing.

Example 9: The ME hearing instrument of any of examples 1-8, wherein the housing defines or contains a tube configured to direct sound generated by the receiver to an anterior tip of the BTE hearing instrument.

Example 10: The BTE hearing instrument of any of examples 1-9, wherein the processing circuitry is configured to modify, based on user-specific settings, signals representing sound detected by microphones.

Example 11: A method of assembling hearing instruments includes obtaining first processing circuitry and second processing circuitry, wherein the first processing circuitry is identical to the second processing circuitry; including the first processing circuitry in a housing of a behind-the-ear part of a Receiver-In-Canal (RIC) hearing instrument; and including the second processing circuitry in a housing of a Behind-The-Ear (BTE) hearing instrument, wherein the BTE hearing instrument is configured to include a receiver posterior to a battery of the BTE hearing instrument and the second processing circuitry.

Example 12: The method of example 11, wherein: the BTE hearing instrument further comprises a microphone, and the battery of the BTE hearing instrument shields the microphone from vibrations generated by the receiver.

Example 13: The method of any of examples 11-12, wherein: the BTE hearing instrument further comprises a transducer, and the battery shields the transducer from electromagnetic fields generated by the receiver.

Example 14: The method of any of examples 11-13, wherein: the housing of the behind-the-ear part of the RIC hearing instrument is a first housing of the behind-the-ear part of the RIC hearing instrument, a first module of the RIC hearing instrument includes the first housing of the behind-the-ear part of the RIC hearing instrument and first contact pins, a second module of the RIC hearing instrument includes second contact pins and at least a segment of a cable that transmits signals from the first module of the RIC hearing instrument to an in-ear part of the RIC hearing instrument, the housing of the BTE hearing instrument is a first housing of the BTE hearing instrument, a first module of the BTE hearing instrument includes the first housing of the BTE hearing instrument and third contact pins, a second module of the BTE hearing instrument includes a second housing of the BTE hearing instrument and fourth contact pins, the second housing of the BTE hearing instrument includes the receiver, and the receiver receives signals from the processing circuitry via the third and fourth contact pins.

Example 15: The method of example 14, wherein at least one of: the first housing of the behind-the-ear part of the RIC hearing instrument and the second housing of the behind-the-ear part of the RIC hearing instrument are configured to be user-detachable, or the first housing of the BTE hearing instrument and the second housing of the BTE hearing instrument are configured to be user-detachable.

Example 16: The method of any of examples 11-15, wherein the first processing circuitry and the second processing circuitry are both configured to modify, based on user-specific settings, signals representing sound detected by microphones.

Example 17: A kit comprising: a processing module comprising processing circuitry and processing module contact pins; and a BTE body module comprising: first body module contact pins arranged to contact the processing module contact pins when the BTE body module is mated with the processing module; and a receiver configured to produce sound based on signals received from the processing module via the processing module contact pins and the first body module contact pins, wherein a tube of the BTE body module directs the sound and the receiver is posterior to a battery that provides power to the processing module when the BTE body module is mated with the processing module; and a RIC body module comprising: second body module contact pins arranged to contact the processing module contact pins when the RIC body module is mated with the processing module; and a cable configured to transmit electrical signals from the processing module via the processing module contact pins and the second body module contact pins.

Example 18: The kit of example 17, wherein: the BTE body module defines a first recess, the RIC body module defines a second recess, and the first recess and the Example 19: The kit of example 17, wherein: the BTE body module is positioned on an inferior-anterior surface and an inferior-posterior surface of the processing module when the BTE body module is mated with the processing module, and the RIC body module is positioned on the inferior-anterior surface and the inferior-posterior surface of the processing module when the RIC body module is mated with the processing module.

Example 20: The kit of any of examples 17-19, wherein the RIC body module includes a telecoil.

Example 21: The kit of any of examples 17-20, wherein the processing module includes the battery.

Example 22: The kit of any of examples 17-21, wherein the BTE body module and the RIC body module are configured to be user-detachable from the processing module.

Example 23: The kit of any of examples 17-22, wherein the processing module is sealed separately from the BTE body module and the RIC body module to resist water intrusion into the processing module.

In this disclosure, ordinal terms such as "first," "second," "third," and so on, are not necessarily indicators of positions within an order, but rather may be used to distinguish different instances of the same thing. Examples provided in this disclosure may be used together, separately, or in various combinations. Furthermore, with respect to examples that involve personal data regarding a user, it may be required that such personal data only be used with the permission of the user.

It is to be recognized that depending on the example, certain acts or events of any of the techniques described herein can be performed in a different sequence, may be added, merged, or left out altogether (e.g., not all described acts or events are necessary for the practice of the techniques). Moreover, in certain examples, acts or events may be performed concurrently, e.g., through multi-threaded processing, interrupt processing, or multiple processors, rather than sequentially.

In one or more examples, the functions described may be implemented in hardware, software, firmware, or any combination thereof. If implemented in software, the functions may be stored on or transmitted over, as one or more instructions or code, a computer-readable medium and executed by a hardware-based processing unit. Computer-readable media may include computer-readable storage media, which corresponds to a tangible medium such as data storage media, or communication media including any medium that facilitates transfer of a computer program from one place to another, e.g., according to a communication protocol. In this manner, computer-readable media generally may correspond to (1) tangible computer-readable storage media which is non-transitory or (2) a communication medium such as a signal or carrier wave. Data storage media may be any available media that can be accessed by one or more computers or one or more processing circuits to retrieve instructions, code and/or data structures for implementation of the techniques described in this disclosure. A computer program product may include a computer-readable medium.

By way of example, and not limitation, such computer-readable storage media can comprise RAM, ROM, EEPROM, CD-ROM or other optical disk storage, magnetic disk storage, or other magnetic storage devices, flash memory, cache memory, or any other medium that can be used to store desired program code in the form of instructions or data structures and that can be accessed by a computer. Also, any connection is properly termed a computer-readable medium. For example, if instructions are transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. It should be understood, however, that computer-readable storage media and data storage media do not include connections, carrier waves, signals, or other transient media, but are instead directed to non-transient, tangible storage media. Disk and disc, as used herein, includes compact disc (CD), laser disc, optical disc, digital versatile disc (DVD), floppy disk and Blu-ray disc, where disks usually reproduce data magnetically, while discs reproduce data optically with lasers. Combinations of the above should also be included within the scope of computer-readable media.

Functionality described in this disclosure may be performed by fixed function and/or programmable processing circuitry. For instance, instructions may be executed by fixed function and/or programmable processing circuitry. Such processing circuitry may include one or more processors, such as one or more digital signal processors (DSPs), general purpose microprocessors, application specific integrated circuits (ASICs), field programmable logic arrays (FPGAs), or other equivalent integrated or discrete logic circuitry. Accordingly, the term "processor," as used herein may refer to any of the foregoing structure or any other structure suitable for implementation of the techniques described herein. In addition, in some aspects, the functionality described herein may be provided within dedicated hardware and/or software modules. Also, the techniques could be fully implemented in one or more circuits or logic elements. Processing circuits may be coupled to other components in various ways. For example, a processing circuit may be coupled to other components via an internal device interconnect, a wired or wireless network connection, or another communication medium.

The techniques of this disclosure may be implemented in a wide variety of devices or apparatuses, including a wireless handset, an integrated circuit (IC) or a set of ICs (e.g., a chip set). Various components, modules, or units are described in this disclosure to emphasize functional aspects of devices configured to perform the disclosed techniques, but do not necessarily require realization by different hardware units. Rather, as described above, various units may be combined in a hardware unit or provided by a collection of interoperative hardware units, including one or more processors as described above, in conjunction with suitable software and/or firmware.

Various examples have been described. These and other examples are within the scope of the following claims.

What is claimed is:

1. A Behind-The-Ear (BTE) hearing instrument comprising:

processing circuitry;

a battery that stores energy for use by the processing circuitry; and a housing that contains a receiver configured to output sound, wherein the receiver is positioned within the hearing instrument posterior to the processing circuitry and the battery from a perspective consistent with direction on the body of a user wearing the hearing instrument.

2. The BTE hearing instrument of claim 1, wherein:

the BTE hearing instrument further comprises a microphone, and the battery shields the microphone from vibrations generated by the receiver.

3. The BTE hearing instrument of claim 1, wherein:

the BTE hearing instrument further comprises a transducer, and the battery shields the transducer from electromagnetic fields generated by the receiver.

4. The BTE hearing instrument of claim 1, wherein:

the housing is a first housing, the BTE hearing instrument further comprises a second housing that contains the processing circuitry, and the first housing is coupled to the second housing.

5. The BTE hearing instrument of claim 4, wherein:

the second housing is sealed to resist water intrusion into the second housing.

6. The BTE hearing instrument of claim 4, further comprising:

a first module that includes the first housing and first contact pins, and a second module that includes the second housing and second contact pins, wherein the first contact pins are positioned to contact the second contact pins and the receiver is configured to receive signals from the processing circuitry via the first and second contact pins.

7. The BTE hearing instrument of claim 4, wherein the first housing and the second housing are configured to be user-detachable from one another.

8. The BTE hearing instrument of claim 4, wherein the first housing is positioned on an inferior-anterior surface and an inferior-posterior surface of the second housing when the second housing is mated with the first housing.

9. The BTE hearing instrument of claim 1, wherein the housing defines or contains a tube configured to direct sound generated by the receiver to an anterior tip of the BTE hearing instrument.

10. The BTE hearing instrument of claim 1, wherein the processing circuitry is configured to modify, based on user-specific settings, signals representing sound detected by microphones.

11. A method of assembling hearing instruments, the method comprising:

obtaining first processing circuitry and second processing circuitry, wherein the first processing circuitry is identical to the second processing circuitry;

including the first processing circuitry in a housing of a behind-the-ear part of a Receiver-In-Canal (RIC) hearing instrument; and including the second processing circuitry in a housing of a Behind-The-Ear (BTE) hearing instrument, wherein the BTE hearing instrument is configured to include a receiver posterior to a battery of the BTE hearing instrument and the second processing circuitry from a perspective consistent with direction on the body of a user wearing the BTE hearing instrument.

* * * * *